United States Patent [19]

Salzer

[11] 4,008,451

[45] Feb. 15, 1977

[54] HIGH-VOLTAGE FUSE AND PROCESS OF MANUFACTURING THE SAME

[75] Inventor: Erwin Salzer, Waban, Mass.

[73] Assignee: The Chase-Shawmut Company, Newburyport, Mass.

[22] Filed: Sept. 22, 1975

[21] Appl. No.: 615,810

[52] U.S. Cl. ..... 337/161; 337/158; 29/623; 337/295

[51] Int. Cl.[2] ..... H01H 85/08; H01H 85/12

[58] Field of Search ..... 337/161, 162, 158, 159, 337/160, 290, 293, 295; 29/623

[56] References Cited

UNITED STATES PATENTS

| | | | |
|---|---|---|---|
| 3,571,775 | 3/1971 | Kozacka | 337/161 |
| 3,810,061 | 5/1974 | Salzer | 337/159 |

*Primary Examiner*—Harold Broome

[57] ABSTRACT

A high-voltage fuse having a casing closed at each end thereof by a pair of composite plug terminals. Each of these composite plug terminals is made up of a pair of semi-cylindrical complementary parts. The fuse includes a pair of helically wound fusible element means whose longitudinal axes are parallel to each other and spaced from each other. One of said pair of fusible element means and one pair of semi-cylindrical terminal parts are arranged to one side of a plane of symmetry extending in a direction longitudinally of the casing of the fuse. The other of said pair of fusible element means and another pair of semi-cylindrical terminal parts are arranged to the other side of the aforementioned plane of symmetry. Both helically wound fusible element means are initially wound around metal rods which are subsequently removed from the fusible element means and from the casing of the fuse when the fusible element means are sufficiently braced by the pulverulent arc-quenching filler inside the casing to allow withdrawal of the aforementioned metal rods.

8 Claims, 10 Drawing Figures

HIGH-VOLTAGE FUSE AND PROCESS OF MANUFACTURING THE SAME

BACKGROUND OF THE INVENTION

This invention relates to fuses for elevated circuit voltages, e.g. 15 kv, wherein the fusible element means are wound helically to make it possible to arrange within a casing, or fuse tube, of a given length fusible element means which exceed that length. It is very often desirable to arrange between the terminal elements of a fuse a plurality of parallel-connected fusible element means, e.g. in form of silver ribbons having points of reduced cross-sectional area spaced from each other in a direction longitudinally of the ribbons. The high-current interrupting performance as well as the low-current interrupting performance of parallel connected fusible elements in ribbon form is superior to that of a single fusible element of equal current-carrying capacity. Generally a plurality of parallel connected fusible elements is wound around a common support, or mandrel, of insulating material. In this instance the individual helically wound fusible elements are arranged in coaxial relation, have the same pitch, and have a predetermined fixed spacing from each other. When the number of helically wound parallel connected fusible elements is large, the axial spacing between parallel connected fusible elements is small, and this adversely affects the operation of the fuse. In particular, the presence of a large number of helically wound axially narrowly spaced fusible elements tends to result, when the fuse blows, in a merger of parallel current paths into one single current path. In other words, and being more specific, there occurs a breakdown of the insulation between axially spaced points of the parallel current paths by excessive growth and consequent merger of the fulgurites formed at such points. A reduction of the number of helically wound parallel connected fusible elements results in an increase of the axial spacing between the turns of the fusible element means, but may result in intolerable conditions attributable to excessive metal concentration and reduction of the interface between the fusible element means and the arc-quenching filler. Reduction of the number of parallel-connected fusible elements may also be detrimental to the low overload current performance of the fuse.

Some of the above limitations may be avoided by resorting to a plurality of parallel connected helically wound fusible elements which are not arranged coaxially but more or less evenly distributed over the cross-sectional area of the fuse tube. A typical member of this family of fuses is disclosed in U.S. Pat. No. 3,571,775 to F. J. Kozacka et al, Mar. 23, 1971, for HIGH-VOLTAGE FUSE HAVING A PLURALITY OF HELICALLY WOUND RIBBON FUSE LINKS. Fuses as disclosed in that patent are limited to helical fusible elements of critically small diameters — from three-sixteenths to one-half inch — which critically limits the length of the fusible elements that can be arranged inside a fuse tube of given length.

In another kind of fuses such as, for instance, those disclosed in U.S. Pat. No. 3,460,085 to B. T. McAllister et al, Aug. 5, 1969, for FUSE AND FUSE ELEMENT SUPPORTS FOR USE THEREIN a pair of helically wound fusible element means is arranged side by side in a common tubular casing or fuse tube. One limitation of this structure consists in that its fusible element means require relatively complex positioning means, and more importantly that it lends itself not to a subdivision of each of its two helically wound fusible element means into a plurality of axially spaced parallel connected sub-elements of equal pitch.

Most prior art high-voltage fuses lacking a support for a plurality of helically wound fusible elements are subject to the danger of distortion of their fusible elements during the process step of filling a pulverulent arc-quenching filler into the casing or fuse tube.

Fuses manufactured and constructed in accordance with U.S. Pat. No. 3,848,214, 11/12/74, to Erwin Salzer, for METHOD OF ASSEMBLING ELECTRIC HIGH-VOLTAGE FUSES AND SUBASSEMBLY THEREFOR are not subject to this limitation, but the temporary fusible element supporting structure disclosed in that patent is only applicable to a coaxial arrangement of all parallel-connected helically wound fusible elements. This, in turn, precludes to maximize the degree of dispersion of fuse link metal in the arc-quenching filler material or, in other words, to maximize the interface between fuse link metal and arc-quenching filler material.

It is the prime object of the present invention to provide electric fuses for elevated circuit voltages that do not require a permanent insulating mandrel or the like for supporting the helically wound fusible elements thereof, whose fusible elements are not subject to the danger of displacement of distortion during the process step of filling the casing of the fuse with a pulverulent arc-quenching filler, and whose helically wound fusible elements are arranged around parallel, spaced axes rather than in coaxial relation.

Another object of this invention is to provide a process for manufacturing electric fuses having the above referred-to desirable features.

SUMMARY OF THE INVENTION

The process of manufacturing electric fuses in accordance with this invention includes the steps of a. forming a first squirrel-cage-like structure out of a first pair of spaced, substantially semi-cylindrical metal blocks and a first plurality of metal rods arranged parallel to the axis of said first pair of metal blocks, of winding a first fusible element means substantially helically around said first plurality of rods and conductively connecting the ends of said first fusible element means to said first pair of metal blocks;

b. forming a second squirrel-cage-like structure of a second pair of spaced substantially semi-cylindrical metal blocks and a second plurality of metal rods arranged parallel to the axes of said second pair of metal blocks, winding a second fusible element means substantially helically around said second plurality of rods and conductively connecting the ends of said second fusible element means to said second pair of metal blocks;

c. juxtaposing the planar surfaces of said first pair of metal blocks and the planar surfaces of said second pair of metal blocks, inserting said first squirrel-cage-like structure and said second squirrel-cage-like structure into a common tubular casing, affixing said first pair and said second pair of metal blocks to the ends of said casing, and filling said casing with a pulverulent arc-quenching filler; and d. separating said first plurality of rods from said first fusible element means and separating said second plurality of rods from said second fusible element means after said first fusible element means and said second fusible element means are embedded in and supported by said arc-quenching filler and withdrawing said first plurality of rods and said second plurality of rods from said casing.

An electric fuse embodying this invention includes a. a tubular casing of electric insulating material;

b. a pulverulent arc-quenching filler inside said casing;

c. first substantially helically wound fusible element means arranged to one side of a median plane of said casing extending in a direction longitudinally thereof and subdividing the space inside of an bounded by said casing into two substantially equal portions;

d. second substantially helically wound fusible element means arranged to the other side of said median plane; and e. a pair of cylindrical plug terminals plugging the ends of said casing and conductively interconnected by said first and said second fusible element means, each of said pair of plug terminals including a pair of complementary substantially semi-cylindrical metal blocks and mechanical fastener means integrating said pair of metal blocks into a unitary structure.

DESCRIPTION OF PREFERRED EMBODIMENT

Figure 1:
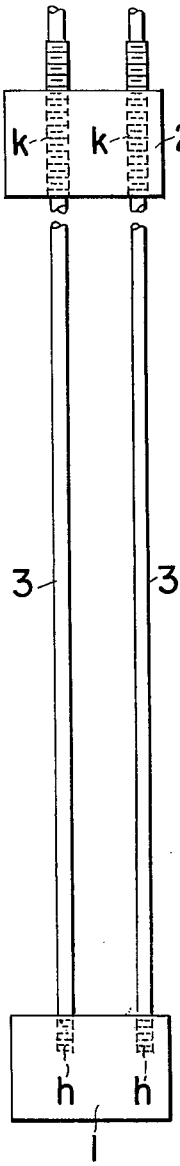
FIGS. 1 and 1*a* are side elevations of two complementary squirrel-cage-like structures.

The embodiment of the invention disclosed below is predicated upon the method of assembly disclosed and claimed in my U.S. Pat. Nos. 3,810,061; May 7, 1974 for HIGH VOLTAGE FUSE and 3,848,214; Nov. 12, 1974 for METHOD OF ASSEMBLING HIGH-VOLTAGE FUSES AND SUBASSEMBLY THEREFOR. Reference may be had to these two patents for details of that assembly process which are outlined below in a relatively concise fashion.

Referring now to the drawings and more particularly to FIGS. 1, 2, 1*a* and 2*a*, reference characters 1,2 and 1′,2′ have been applied to indicate spaced substantially semi-cylindrical metal blocks and reference characters 3 and 3′ have been applied to indicate metal rods of a relatively stiff metal, i.e. a metal having a relatively high modulus of elasticity. Metal blocks 1 and 1′ are provided with internally screw-threaded blind holes *h* and *h′*, respectively, into which the lower externally screw-threaded ends of rods 3,3′ extend. The blocks 2 and 2′ are provided with internally screw-threaded bores *k* and *k′*, respectively, which extent from one of the end surfaces of blocks 2,2′ to the other. The parts 1,2,3 shown in FIGS. 1 and 2 form a first squirrel-cage-like structure and rods 3 extend parallel to the axes of semi-cylindrical metal blocks 1,2. Similarly, the parts 1′,2′,3′ shown in FIGS. 1*a* and 2*a* form a second squirrel-cage-like structure and rods 3′ extend parallel to the axis of semi-cylindrical metal blocks 1′,2′. Semi-cylindrical metal blocks 1,2,1′,2′ have the same diameter and the same height. If metal blocks 1,1′ are arranged with their planar surfaces in abutting relation they form a first cylindrical plug terminal, and if metal blocks 2,2′ are arranged with their planar surfaces in abutting relation they form a second cylindrical plug terminal.

Figure 3:
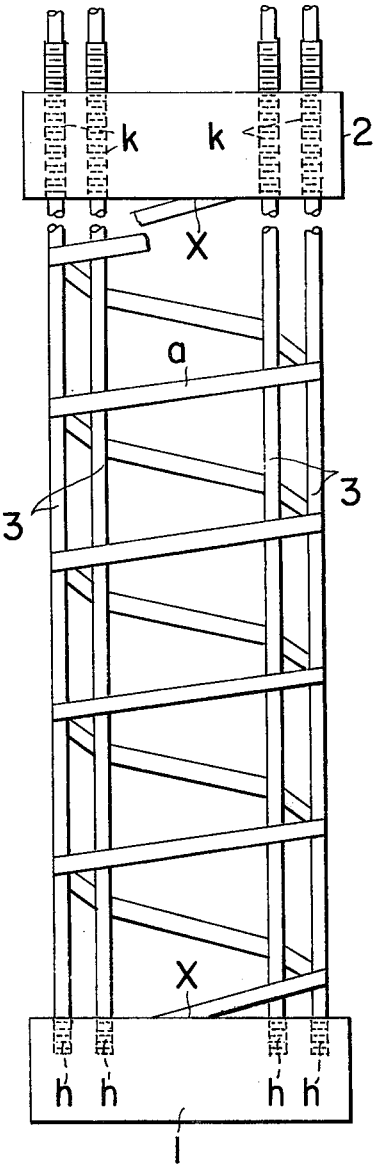
FIG. 3 is a side elevation of the structure of FIG. 1 seen in the direction of the arrow R of FIG. 2 with a helically wound fusible element added to it.
Figure 3A:
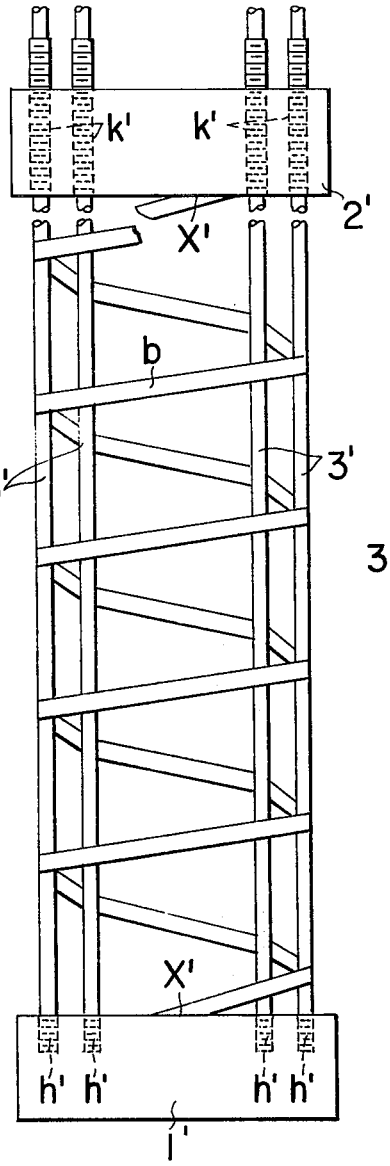
FIG. 3*a* is a side elevation of the structure of FIG. 1*a* seen in the direction S of FIG. 2*a* with a helically wound fusible element added to it.
Figure 1A:
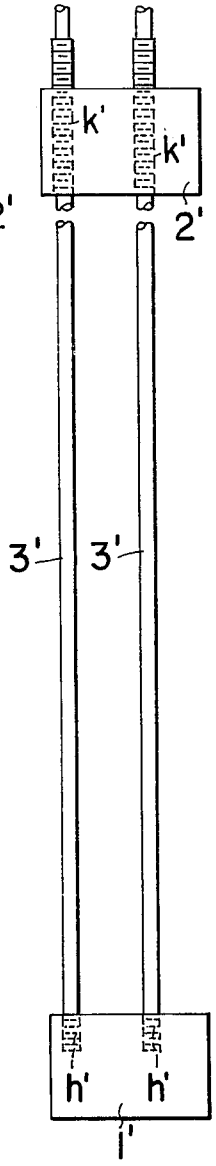
Figure 2:
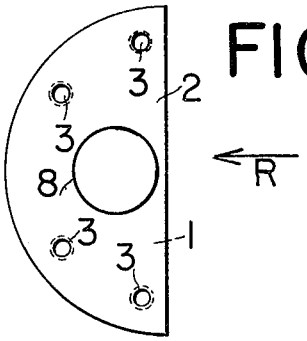
FIG. 2 is a top plan view of the structure of FIG. 1
Figure 2A:
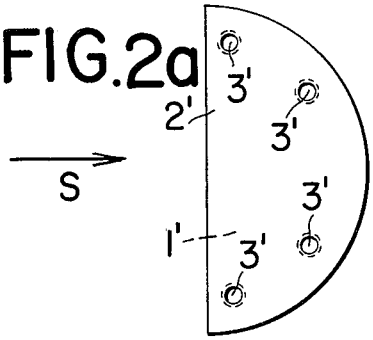
FIG. 2*a* is a top-plan view of the structure of FIG. 1*a;*

FIG. 3 shows the squirrel-cage-like structure 1,2,3 after a fusible element means *a* in form of a ribbon has been wound substantially helically around rods 3 and the ends of fusible element means *a* have been conductively connected to metal blocks 1,2 at points X. In like fashion FIG. 3*a* shows the squirrel-cage-like structure 1′,2′,3′ after a fusible element means *b* in form of a ribbon has been wound substantially helically around rods 3′ and the ends of fusible element means *b* have been conductively connected to metal blocks 1′,2′ at points X′. The conductive connections X and X′ of fusible element means *a* and *b* may include solder joints.

Figure 6:
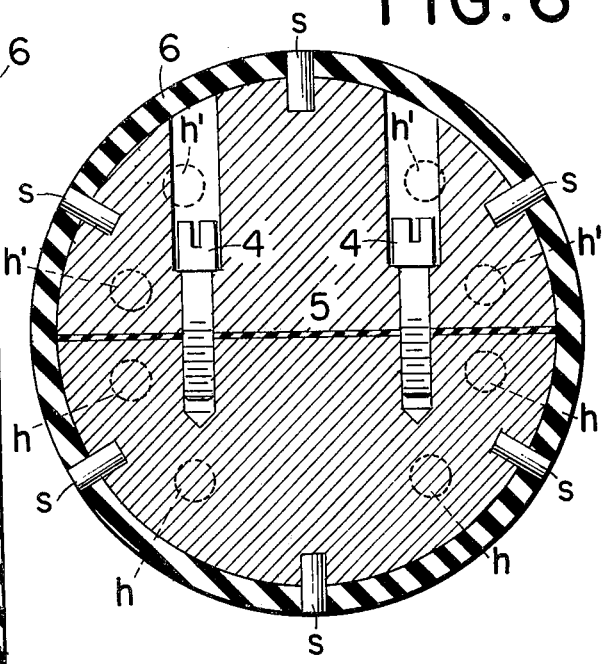
FIG. 6 is a cross-section of the structure of FIG. 4 along 6—6 of FIG. 4.

Blocks 1 and 1′ and blocks 2,2′ are then arranged with their planar surfaces in juxtapposed relation so that blocks 1 and 1′ form a first cylindrical terminal plug and blocks 2 and 2′ form a second cylindrical terminal plug. Blocks 1 and 1′ are joined together by fasteners, e.g. screws 4 and blocks 2 and 2′ are joined together in the same fashion. This is clearly shown in FIG. 6. A rectangular flexible seal 5 is preferably interposed between the juxtaposed planar surfaces of blocks 1,1′ and 2,2′, respectively. After parts 1,2,3*a* and parts 1′,2′,3′,*b* have been integrated by screws 4 into a structural unit, the same is inserted into a tubular casing 6 of electric insulating material, e.g. of synthetic-resin-glass-cloth laminate. Thereupon plugs 1,1′ and 2,2′ are affixed to casing 6 by fasteners, e.g. steel pins *s* projecting through casing 6 into terminal plugs 1,1′ and 2,2′. Thus casing 6 is caused to establish a spacer between terminal plugs 1,1′ and 2,2′ in addition to rods 3,3′ which also form spacers between the aforementioned plug terminals 1,1′ and 2,2′. The next step in the assembly of the fuse consists in filling casing 6 with a pulverulent arc-quenching filler 7, e.g. quartz sand, through an internally screw-threaded aperture 8 formed in terminal plug 2,2′. When filler 7 is duly compacted, as by vibrating of the fuse structure, tapping the sides of casing 6, or both, rods 3 and 3′ are unscrewed from terminal plugs 1,1′ and 2,2′ and withdrawn from casing 6. The voids formed by withdrawal of rods 3,3′ are filled by addition of some filler 7 through aperture 8 into casing 6.

Figure 7:
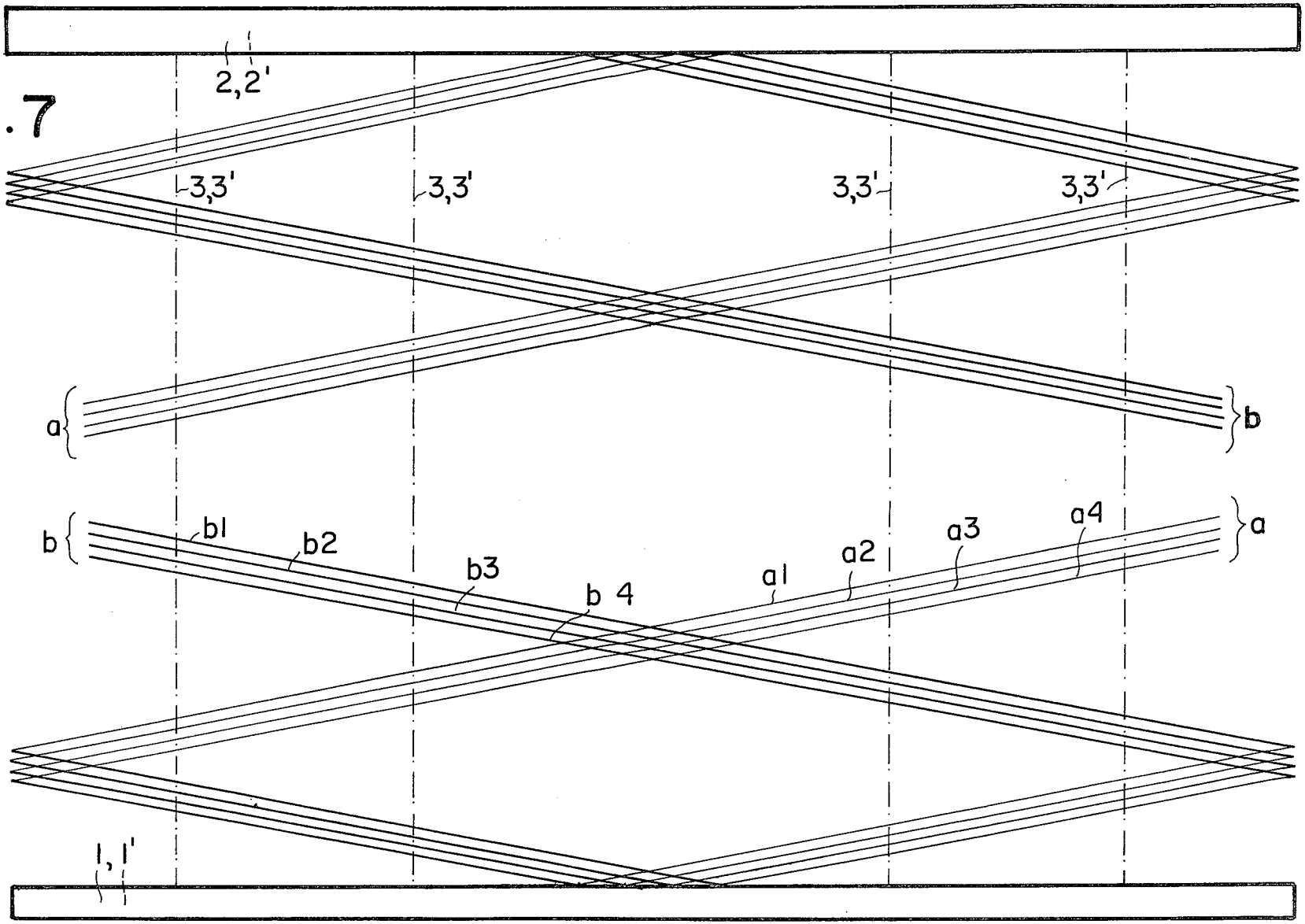
FIG. 7 is a diagrammatic representation of helical windings of fusible element means similar to those shown in FIGS. 4 and 5 developed into a pair of parallel planes.

Each fusible element means *a* and *b* may be subdivided into a plurality of parallel connected fusible elements. This has been shown in FIG. 7. According to that figure fusible element means *a* is sub-divided into four parallel connected fusible elements *a*1,*a*2,*a*3,*a*4 and fusible element means *b* is sub-divided into four parallel connected fusible elements *b*1,*b*2,*b*3,*b*4. In FIG. 7 the dash-and-dot lines 3,3′ have been applied to indicate diagrammatically the eight rods 3,3′. FIG. 7 is drawn in the plane A—A of FIG. 5. FIG. 7 has been arrived at by sectioning windings *a*,*b* of FIG. 5 along plane B—B of FIG. 5, developing the windings *a*,*b* into planes parallel to plane A—A of FIG. 5 and projecting the developed windings *a*,*b* upon plane A—A.

Windings *a*,*b* may either be wound in the same sense or in opposite senses. The latter alternative shown in FIGS. 4 and 7 minimizes the induction of the fuse structure.

Figure 5:
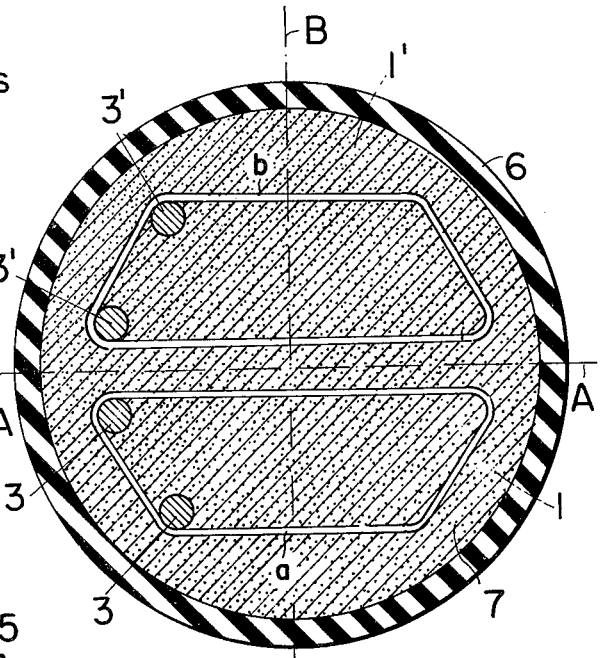
FIG. 5 is a cross-section of the structure of FIG. 4 along 5—5 of FIG. 4, one side of FIG. 5 showing the structure prior to, and the other side of FIG. 5 showing the structure upon complete assembly thereof.

The left side of FIG. 5 shows the fuse structure prior to removal of rods 3,3′ and the right side of FIG. 5 shows the same structure after removal of rods 3,3′.

Figure 4:
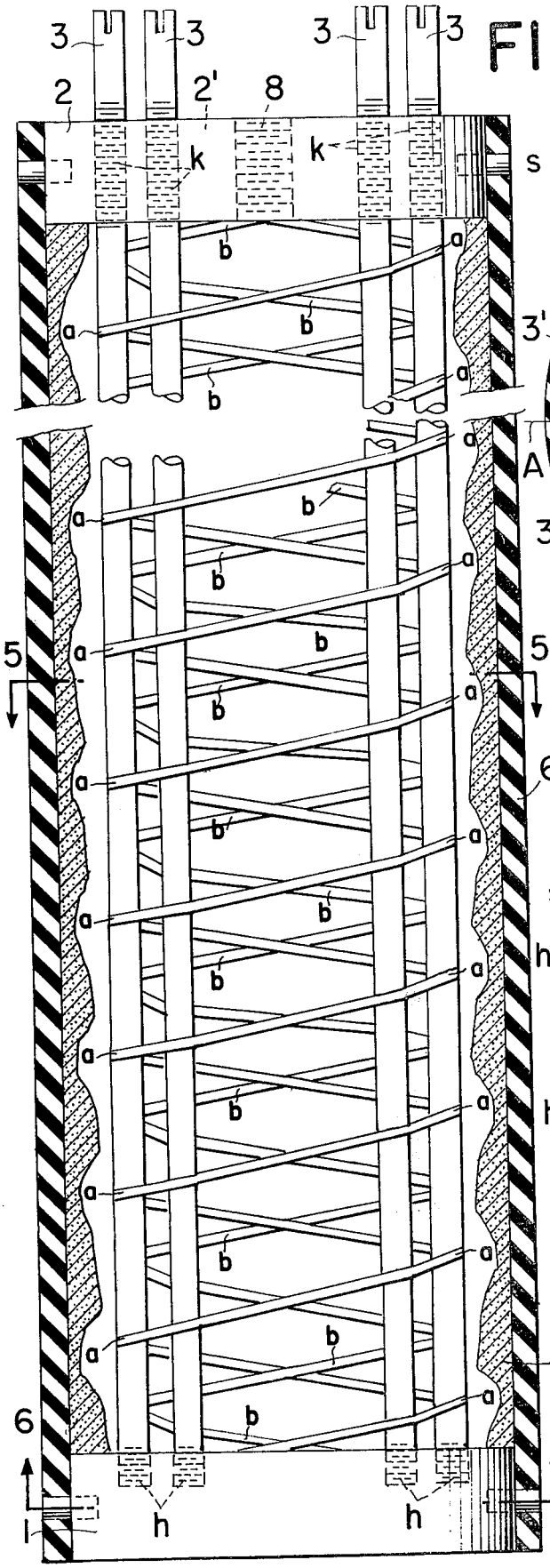
FIG. 4 is a side elevation of a fuse embodying this invention in a more advanced state of assembly, but showing some parts thereof in vertical section.

In the preferred embodiment of the invention illustrated in FIGS. 4 and 5 the fusible element means *a*,*b* are arranged in the lateral surfaces of one of a pair of prisms each having a cross-section substantially in the shape of a trapeze. Each of the aforementioned prisms is located to a different side of the median plane A—A. The widest lateral surfaces of the aforementioned pair of prisms are arranged parallel and immediately adjacent to median plane A—A.

It is desirable to interpose seals (not shown) between terminal plugs 1,1′ and 2,2′ and casing 6, as widely used in the art. Such seals may, e.g., be in the form of O-rings. As an alternative, the seals may take any of the forms disclosed in U.S. Pat. No. 3,250,879 to Philip C. Jacobs, Jr.; 05/10/66 for ELECTRIC FUSE COMPRISING PLUG TERMINALS HAVING AN IMPROVED SEAL AND PINNING MEANS.

I claim as my invention:

1. A process for manufacturing electric fuses including the steps of a. forming a first squirrel-cage-like structure out of a first pair of spaced, substantially semi-cylindrical co-axially arranged metal blocks and a first plurality of metal rods arranged parallel to the axes of said first pair of blocks, of winding a first fusible element means substantially helically around said first plurality of rods and conductively connecting the ends of said first fusible element means to said first pair of blocks;

b. forming a second squirrel-cage-like structure of a second pair of spaced substantially semi-cylindrical co-axially arranged metal blocks and a second plurality of metal rods arranged parallel to the axes of said second pair of blocks, winding a second fusible element means substantially helically around said second plurality of rods and conductively connecting the ends of said second fusible element means to said second pair of blocks;

c. juxtaposing the planar surfaces of said first pair of blocks and the planar surfaces of said second pair of blocks, inserting said first squirrel-cage-like structure and said second squirrel-cage-like structure into a common tubular casing, affixing said first pair and said second pair of blocks to the ends of said casing, and filling said casing with a pulverulent arc-quenching filler; and d. separating said first plurality of rods from said first fusible element means and separating said second plurality of rods from said second fusible element means after said first fusible element means and said second fusible element means are embedded in and supported by said arc-quenching filler, and withdrawing said first plurality of rods and said second plurality of rods from said casing.

2. A process as specified in claim 1 including the step of tying said first squirrel-cage-like structure and said second squirrel-cage-like structure mechanically together to form a structural unit prior to insertion thereof into said tubular casing.

3. An electric fuse including a. a tubular casing of electric insulating material;

b. a pulverulent arc-quenching filler inside said casing;

c. first substantially helically wound fusible element means arranged to one side of a median plane of said casing extending in a direction longitudinally thereof and subdividing the space inside of and bounded by said casing into two substantially equal portions;

d. second substantially helically wound fusible element means arranged to the other side of said median plane; and e. a pair of cylindrical plug terminals plugging the ends of said casing and being conductively interconnected by said first and said second fusible element means, each of said pair of plug terminals including a pair of complementary substantially semi-cylindrical metal blocks joined together by fastener means to form a cylindrical plug terminal.

4. An electric fuse as specified in claim 3 wherein each of said fusible element means is arranged in the lateral surfaces of one of a pair of prisms, each having a cross-section substantially in the shape of a trapeze, each being located at a different side of said median plane, and the widest lateral surfaces of said pair of prisms being arranged immediately adjacent said median plane.

5. An electric fuse as specified in claim 3 wherein a resilient sealing layer is interposed between said pair of semi-cylindrical metal blocks of each of said pair of plug terminals.

6. An electric fuse as specified in claim 3 wherein each pair of semi-cylindrical metal blocks of each of said pair of plug terminals is tied together by screw means arranged at right angles to the planar lateral surfaces of each said pair of metal blocks.

7. An electric fuse as specified in claim 3 wherein said first fusible element means and said second fusible element means are wound in opposite directions.

8. An electric fuse as specified in claim 3 wherein said first fusible element means and said second fusible element means are each sub-divided into a plurality of parallel connected fusible elements.

* * * * *